United States Patent [19]

Dickie et al.

[11] Patent Number: 5,008,083

[45] Date of Patent: Apr. 16, 1991

[54] APPARATUS FOR CENTRIFUGAL SEPARATION OF COAL PARTICLES

[75] Inventors: William Dickie, New Eagle; Joseph A. Cavallaro, Mt. Keesport; Richard P. Killmeyer, Pleasant Hills, all of Pa.

[73] Assignee: The United States of America as represented by the United States Department of Energy, Washington, D.C.

[21] Appl. No.: 238,213

[22] Filed: Aug. 30, 1988

[51] Int. Cl.[5] ..... B01L 11/00; B65D 25/06; B03B 5/32

[52] U.S. Cl. ..... 422/101; 422/72; 422/102; 422/103; 436/177; 209/453; 220/501; 220/502; 210/375

[58] Field of Search ..... 422/72, 101, 99, 102, 422/103; 436/177; 435/296; 73/864.63, 864.91; 251/305, 308, 297, 326; 215/6; 220/4 B-4 E, 20.5, 23.83, 307; 209/453, 490; 210/374, 375, 380.1, 380.3

[56] References Cited

U.S. PATENT DOCUMENTS 3,922,511 11/1975 Letize et al. .
4,470,901 9/1984 Burgess .
4,695,372 9/1987 Warzinski et al. .

OTHER PUBLICATIONS

Cavallaro et al., "Development of a Centrifugal Float--Sink Procedure for Gravimetric Evaluation of Ultrafin Coals", PETC 87-59.
"Fine Size Centrifugal Float-Sink Procedure".
Palowitch and Deurbrouck, "The Performance Characteristics of American Coal Washers".
Rao, "Characterization and Evaluation of Washability of Alaskan Coals", DOE/ET/13350, 1986.

*Primary Examiner*—Robert A. Wax
*Assistant Examiner*—William H. Beisner
*Attorney, Agent, or Firm*—Mark P. Dvorscak; Robert J. Fisher; William R. Moser

[57] ABSTRACT

A gravimetric cell for centrifugal separation of fine coal by density has a cylindrical body and a butterfly valve or other apparatus for selectively sealing the body radially across the approximate center of the cylinder. A removable top is provided which seals the cylinder in the centrifuge and in unvented areas.

5 Claims, 4 Drawing Sheets

APPARATUS FOR CENTRIFUGAL SEPARATION OF COAL PARTICLES

CONTRACTUAL ORIGIN OF THE INVENTION

The United States Government has rights in this invention because the inventors are employed by the Department of Energy.

BACKGROUND OF THE INVENTION

This invention relates to apparatus for centrifugal separation, and more particularly, to apparatus for separating fine (less than 600 microns) coal/mineral particles having a relatively low density and high carbon content from coal/mineral particles having a relatively high density and therefore high ash content. The invention also relates to any other fine size solid particulate material or ore in which a density fractionation is desired.

Coal is often processed before combustion to remove undesired particles having a relatively high ash and/or mineral content from particles having a relatively high carbon content. Combustion efficiency is improved by processing, or cleaning, the coal in this manner because the high carbon particles burn well, but the high ash/-mineral particles do not. Moreover, the high ash/mineral particles introduce undesired by-products into the atmosphere if they are not removed after combustion. For these reasons, efforts are made to remove the high ash/mineral particles before combustion.

When attempting to clean coal, the composition of the coal is periodically measured or characterized by fractionating the coal particles according to density. The separation can be made through gravimetric processes because the specific gravity of the ash/mineral particles is higher (about 1.8–2.6) than the specific gravity of the carbon particles (about 1.3).

The composition of a fine size coal sample can be determined by placing the coal in a liquid having a specific gravity of perhaps 1.2 to 3.0, and placing the solution in a centrifuge Heavy organic liquids such as perchloroethylene, naphtha or toluene are suitable for this purpose, but those liquids produce hazardous fumes in atmospheric conditions and should be utilized with caution.

As the centrifuge rotates the solution, low density particles having a specific gravity which is less than the specific gravity of the liquid form a "float" layer on the top of the solution, and high density particles form a "sink" layer on the bottom of the solution. A "clear" layer which consists primarily of the liquid is formed between the float and sink layers. The composition of the sample is determined by separately removing and weighing the float and sink layers.

Coal samples such as those just described can be placed in hourglass flasks for centrifugal separation. Such flasks are generally cylindrical, but have a narrow diameter in the neck of the flask. A sample solution is poured into the flask to about the top of the flask, and the flask is placed upright in the centrifuge without a cover. In the centrifuge, the high carbon particles in the solution float to the top of the solution, and the high ash/mineral particles sink to the bottom. The flask is then removed from the centrifuge and carried to a vented work area.

At the work area, a rubber stop which has the diameter of the neck of the hourglass flask is pushed through the float layer and secured in the neck of the flask to seal the neck. The float layer is then poured out of the flask so that the high carbon particles can be filtered from the solution and weighed. The rubber stop is then removed so that the sink layer can be poured out of the flask and measured in the same manner.

One problem with hourglass flasks is that the rubber stop upsets the float layer as the stop enters the flask, reducing the accuracy and reliability of the results. In addition, this technique is tedious and time-consuming. Thus, there is a need for apparatus for separating high carbon coal particles from high ash/mineral coal particles in gravimetric processes which provides more accurate, reliable results, quickly and easily.

Another problem with hourglass flasks is that hazardous fumes are released when the flask is in the centrifuge, and when it is moved from the centrifuge to the vented work area. Thus, there is also a need for apparatus for separating high carbon coal particles from high ash/mineral coal particles in gravimetric processes which do not release hazardous fumes in unvented areas.

Accordingly, one object of this invention is to provide new and improved techniques and apparatus for centrifugal float/sink separation.

Another object is to provide new and improved gravimetric cells for the centrifugal separation of coal/-mineral matter which provide accurate, reliable results.

Yet another object is to provide new and improved gravimetric cells for the centrifugal separation of coal which produce more efficient separations in a less tedious manner in less time.

Still another object is to provide new and improved gravimetric cells for the centrifugal separation of coal/-mineral matter which do not release hazardous fumes in unvented areas.

SUMMARY OF THE INVENTION

In keeping with one aspect of this invention, a gravimetric cell for the centrifugal separation of coal has a cylindrical body and a butterfly valve or other apparatus for selectively sealing the body radially across the approximate center of the cylinder. A removable top is provided which seals the cylinder in the centrifuge and in unvented areas.

BRIEF DESCRIPTION OF THE DRAWINGS

The above-mentioned and other features of an embodiment of the invention and the manner of obtaining them will become more apparent, and will be best understood by reference to the following description, taken in conjunction with the accompanying drawings in which.

DETAILED DESCRIPTION

Figure 1:
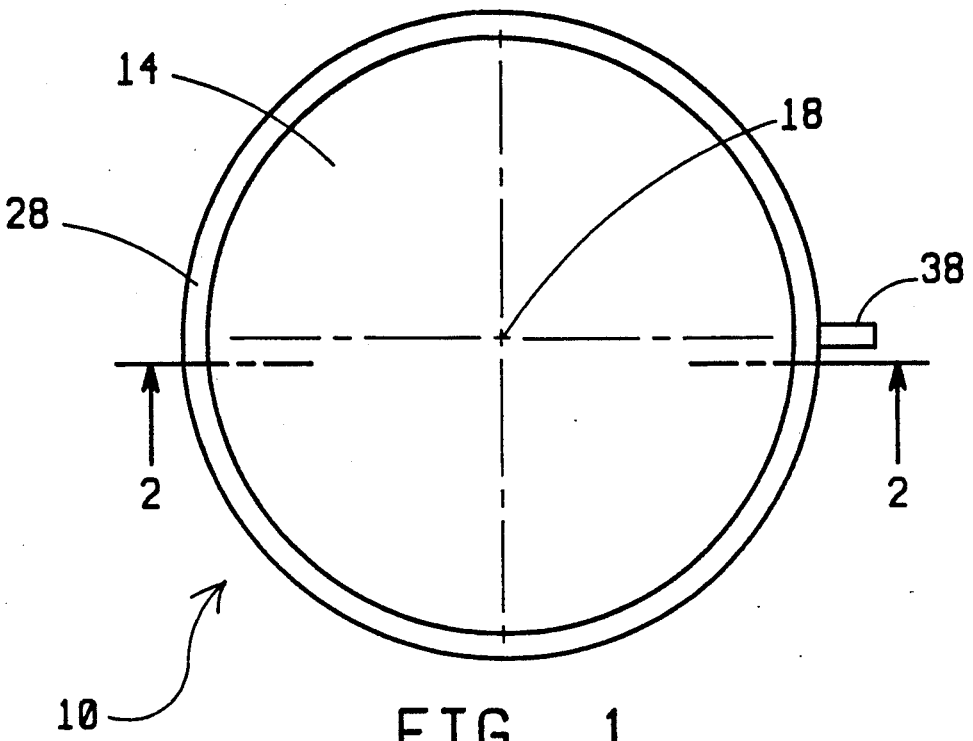
FIG. 1 is a top view of a gravimetric cell for centrifugal separation of coal made in accordance with the invention, shown with the top secured to the cell.
Figure 2:
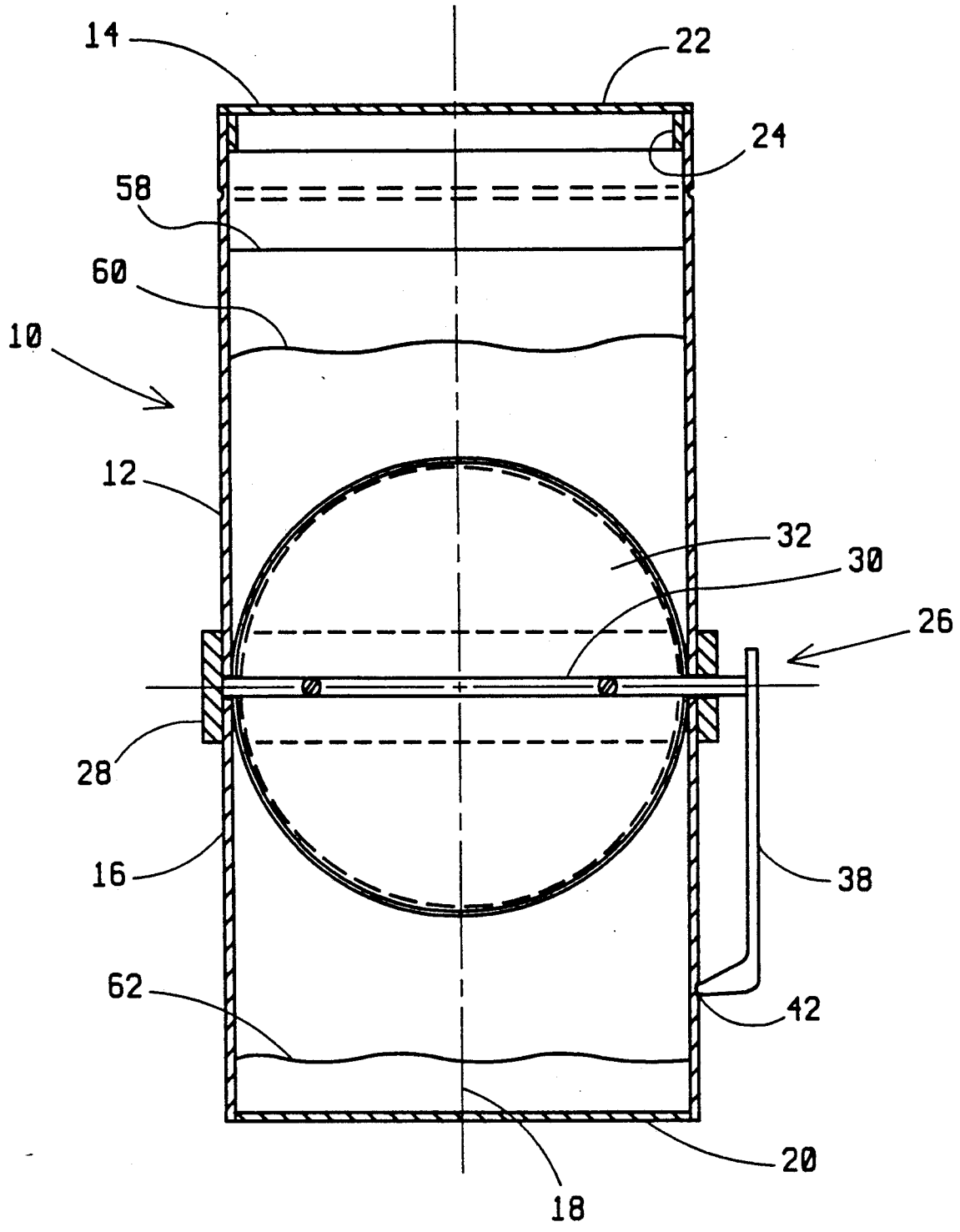
FIG. 2 is a sectional view of the cell of FIG. 1, taken along lines 2—2 in FIG. 1.
Figure 3:
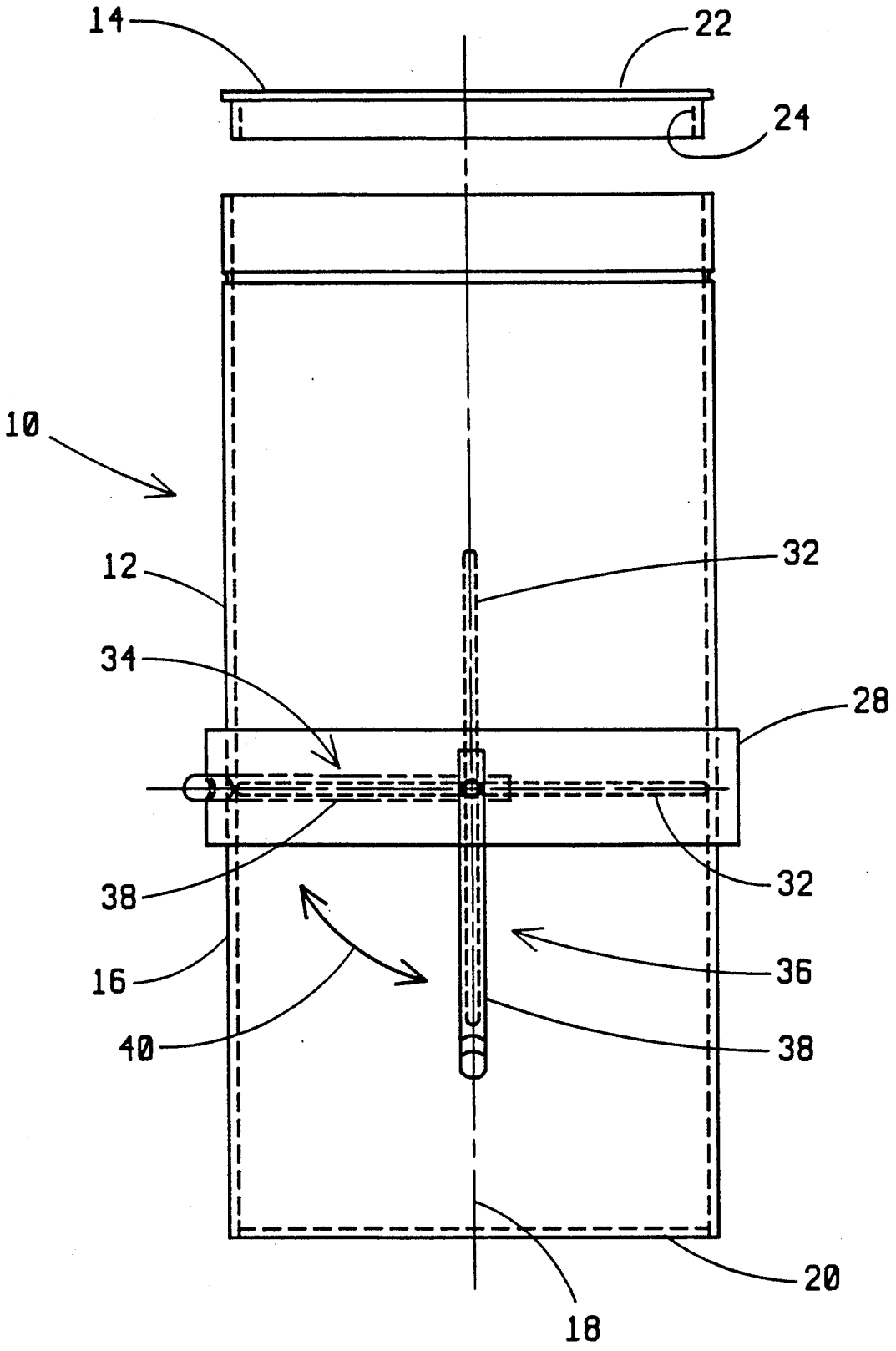
FIG. 3 is a side view of the cell of FIG. 1, shown with the top removed from the cell.

As seen in FIGS. 1, 2 and 3, a cell 10 includes a body 12 and top 14. The body 12 is generally cylindrical, and includes a cylindrical wall 16 having a center axis 18, and a bottom 20. The body 12 may be of unitary or multi-piece construction, and may be made of any suitable material, such as stainless steel or some other material which resists corrosion and is of sufficient strength. The bottom 20 could be threaded or secured by any other suitable means to provide a leak-proof seal to the wall 16. The dimensions of the body 12 can be varied to fit properly in most centrifuges.

The top 14 includes a horizontal cover plate 22 which covers the body 12, and a vertical wall 24 which is secured to the plate 22 and fits within the wall 16 of the body 12. The top 14 seals the body 12 to prevent hazardous fumes from escaping when it is in place, yet may be easily removed when the cell 10 is in a vented work area or other safe place. A variety of sealing material (not shown) may be added to the cell 10 to more completely seal the top of the cell 10, if desired.

The cell 10 also includes a butterfly valve 26. The valve 26 is secured to a belt 28 on the body 12. A rod 30 extends radially across the body 12 at about the axial center of the wall 16. The rod 30 includes appropriate seals which prevent liquid or fumes from leaking through the valve 26. However, the rod 30 extends through one side of the belt 28 so that the valve 26 can be controlled from outside of the body 12.

A butterfly plate 32 is secured to the rod 30 for rotation of the plate 32 within the body 12. When the plate 32 is horizontal, as at reference numeral 34 in FIG. 3, the plate 32 forms a seal within the body 12. When the plate 32 is vertical, as at reference numeral 36 in FIG. 3, the plate 32 allows fluids and particles to flow and move substantially without obstruction in the cell 10. An O-ring (not shown) or other suitable structure around the periphery of the plate 32 may be used to create a tight seal when the plate 32 is in the horizontal position The position of the plate 32 is controlled by an external lever 38. The lever 38 may be any suitable size and shape, but is preferably close to the body 12 when the plate 32 is vertical The lever 38 (and the plate 32) move in the directions of the arrow 40 in FIG. 3. A dimple 42 is provided in the body 12 to maintain the lever 38 and the plate 32 in the vertical position when the lever 38 is in the dimple 42.

Figure 4:
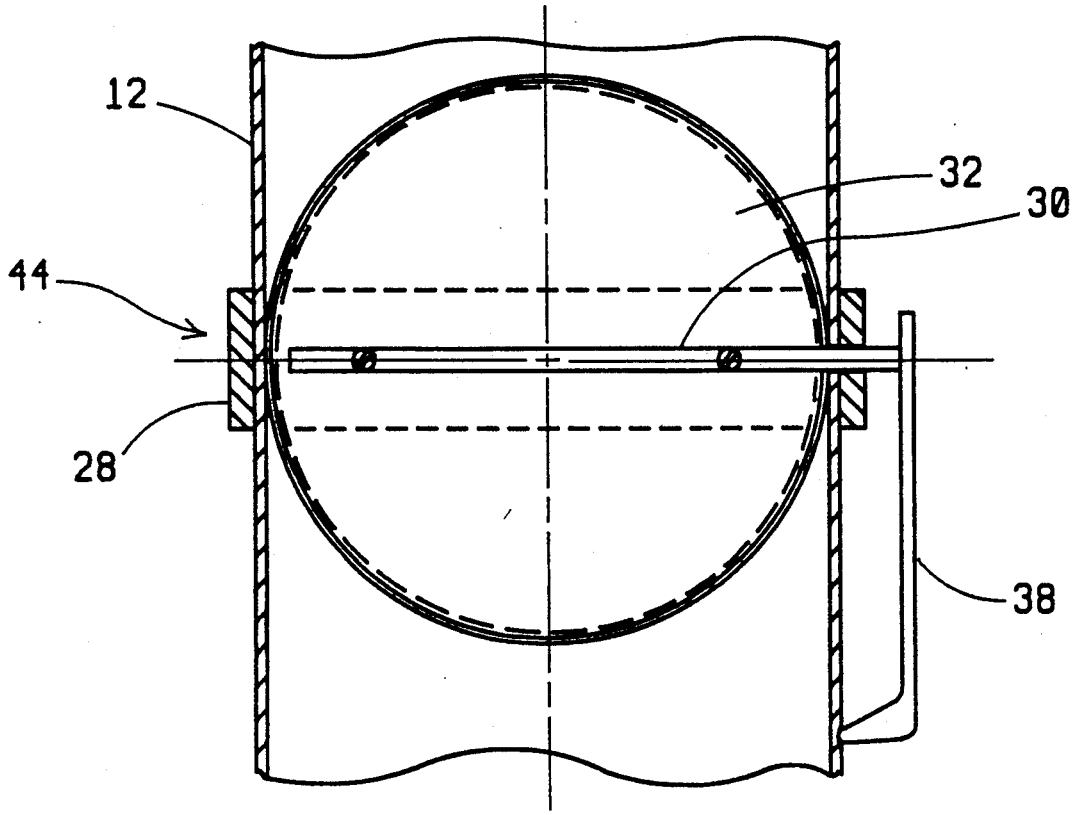
FIG. 4 is an alternate embodiment of a portion of the apparatus of FIG. 2.
Figure 5:
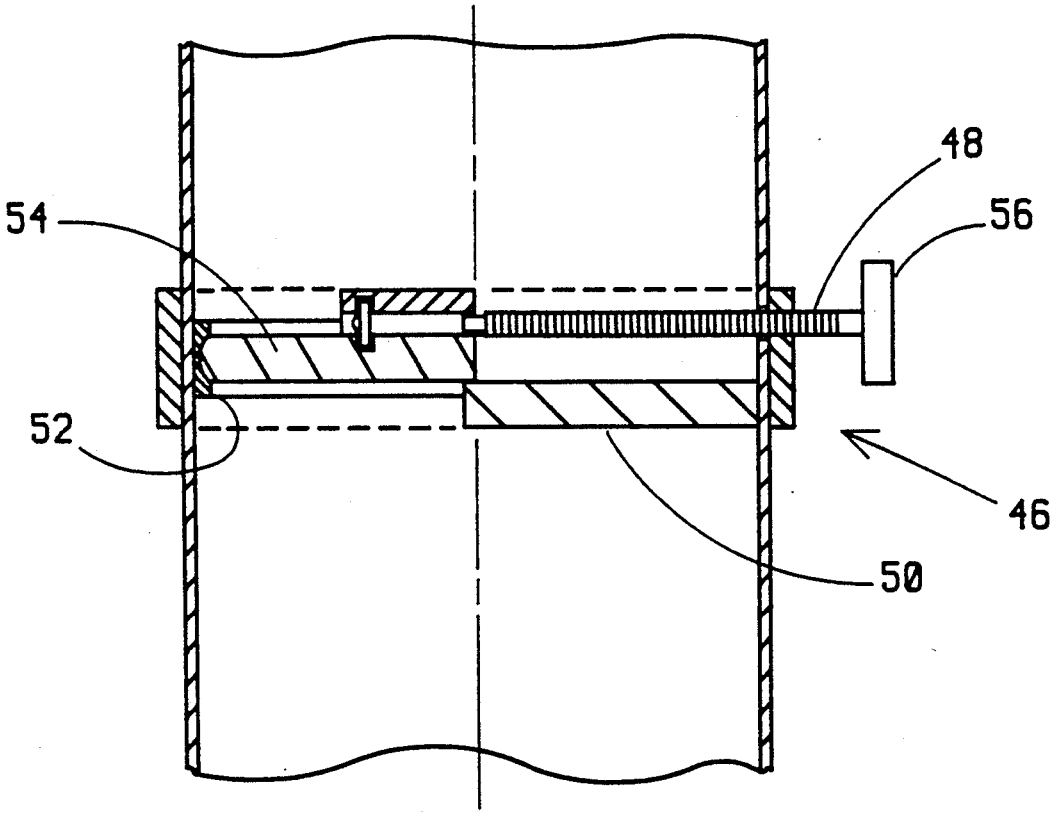
FIG. 5 is another alternate embodiment of a portion of the apparatus of FIG. 2.

The valve 26 need not be the butterfly valve shown in FIGS. 2 and 3, but could alternatively be a wing valve 44, as shown in FIG. 4, or a sliding plate valve 46, as shown in FIG. 5. The wing valve 44 is similar to the valve 26, but does not extend into the wall 16 at the end of the rod 30 opposite to the lever 38. The valve 46 includes a threaded shaft 48, a semi-circular fixed piece 50, a seat 52, and a semi-circular movable piece 54 secured to the shaft 48. A knob 56 is secured to the shaft 48 for rotation of the shaft 48.

The cell 10 is used to separate high density particles from low density particles in coal or other materials. Coal contains some particles which have a high carbon content and are desirable for combustion, and some high ash and/or mineral particles, which are not desirable for combustion. The high carbon particles have a relatively high density (1.8–2.6), and the high ash/mineral particles have relatively low density (about 1.3).

Before the coal is placed in the cell 10, it is mixed with a suitable liquid having a specific gravity which is between the specific gravity of the high carbon particles and that of the high ash/mineral particles. Perchloroethylene, which has a specific gravity of about 1.6, naphtha, toluene or a naphtha/toluene solution having a specific gravity of about 1.0 may be used for this purpose. However, hazardous fumes created by such chemicals must be controlled to protect against injuries.

In use, the liquid/coal solution is placed in the cell 10 in a vented work area with the valve 26 in vertical position 36 (FIG. 3). The solution substantially fills the cell 10 to the line 58 (FIG. 2), which is above the valve 26. The top 14 is then secured to the body 12, and the cell 10 is placed in a centrifuge. Any number of cells 10 may be placed in the centrifuge, as desired or required to maintain balance in the centrifuge.

As the cell 10 spins in the centrifuge, the valve 26 is held open by the dimple 42 in which the lever 38 is secured. Particles which have a specific gravity greater than the specific gravity of the liquid in the solution rise to the top of the cell 10 to form a "float" layer between the line 58 and a line 60 (which is also above the valve 26), and particles which have a specific gravity less than the specific gravity of the liquid fall to the bottom of the cell 10 beneath a line 62. The line 62 is below the valve 26. The heavier particles form a "sink" layer on the bottom of the cell 10. A "clear" layer of liquid and perhaps a few particles is formed between the lines 60 and 62.

When the particles in the solution have been separated in the centrifuge, the cell 10 is removed (with the top 14 in place) and the valve 26 is slowly and carefully placed in the horizontal position 34 (FIG. 3) to physically isolate the float layer from the sink layer, without disturbing either layer. The cell 10 is then taken to a vented work area where the top 14 can be safely removed.

With the valve 26 closed, the float layer can be simply poured out of the cell 10, filtered and weighed to measure the carbon content of the coal. The valve 26 can then be opened so that the sink layer can be poured out of the cell 10 and weighed to measure the ash/mineral content of the coal. In this manner, the composition of the coal is determined without disturbing the float layer during the measuring process, and without permitting hazardous fumes to escape in unvented areas.

The results of actual tests comparing the gravimetric cell of this invention with an hour glass flask are shown below. The results show about 2% to over 25% better separation with the inventive gravimetric cell, at various centrifuge speeds. Thus, the results obtained with the inventive cell show significantly more efficient separation, i.e., that the solution actually had a higher clean coal recovery at a low ash level than that which was indicated by the hour glass flask.

Centrifugal Float-Sink Tests Comparing New Gravimetric Cell with Hour Glass Flask Constant Conditions

| | |
|---|---|
| Retention Time, - 5 min. | Moisture Content, - 0% |
| Solids - 8.2% | Conditioning Time, - .5 min. |
| Reagent Dosage, 1#/ton - 10 | Ultrasonic Time, - 1.5 min. |

| | New Gravimetric Cell | | Hour Glass Flask | |
|---|---|---|---|---|
| Layer | Coal | Ash | Coal | Ash |
| | Centrifuge Speed, 1500 rpm | | | |
| Float 1.30 | 36.7 | 2.4 | 35.3 | 2.7 |
| Sink 1.30 | 63.3 | 37.7 | 64.7 | 36.9 |
| | Centrifuge Speed, 2850 rpm | | | |
| Float 1.30 | 37.0 | 1.9 | 29.2 | 2.3 |
| Sink 1.30 | 63.3 | 38.2 | 70.8 | 35.6 |
| | Centrifuge Speed, 4200 rpm | | | |
| Float 1.30 | 35.9 | 1.9 | 29.7 | 2.4 |

-continued

| Centrifugal Float-Sink Tests Comparing New Gravimetric Cell with Hour Glass Flask | | | | |
|---|---|---|---|---|
| Sink 1.30 | 64.1 | 37.9 | 70.3 | 34.6 |

The many advantages of this invention are now apparent. The float layer is not disturbed when the float and sink layers are isolated from each other, resulting in a more efficient, accurate and reliable separation. In addition, hazardous fumes do not escape in unvented areas. Thus, the new cell provides more efficient separations in a less tedious manner in less time, and with the top secured, preventing escape of hazardous fumes in unvented areas.

While the principles of the invention have been described above in connection with specific apparatus and applications, it is to be understood that this description is made only by way of example and not as a limitation on the scope of the invention.

The embodiments of this invention in which an exclusive property or privilege is claimed are defined as follows:

1. Apparatus for separating by centrifugation relatively high density particles from relatively low density particles suspended in a solution which includes a liquid having a density intermediate of the densities of the high and low density particles comprising:

a cell configured for placement in a centrifuge having a lower portion in which the high density particles reside and form a sink layer when they are separated from the low density particles, an upper portion in which the low density particles reside and form a float layer after separation from the high density particles, a central portion between said lower portion and said upper portion, and an open top;

means for selectively sealing and unsealing said open top to prevent hazardous fumes from escaping;

means for selectively isolating the sink layer from the float layer when said top is sealed, without unsealing said top, and without disturbing either layer;

means for locking for maintaining the isolating means in an open position; and said isolating means including a rod extending horizontally through the cell, and a closure means secured to the rod.

2. The apparatus of claim 1 wherein said cell includes a cylindrical wall having a lever side and a side opposite the layer side and said closure means includes a rotatable plate secured to the rod, a belt secured to the cell, and a layer operatively connected to the rod; the rod extending through the belt and the lever side and the opposite side of the cylindrical wall;

the lever selectively rotating the plate between a substantially open position allowing unobstructed flow through the cell during centrifugation, and a substantially closed position forming a seal within the cell subsequent to centrifugation, thereby isolating the float layer from the sink layer.

3. The apparatus of claim 1 wherein said cell comprises a cylindrical body, and said means for sealing the top of said cell comprises a horizontal top with a vertical wall which is secured within said cylindrical body.

4. The apparatus of claim 2 wherein the cylindrical wall of the cell has an outside surface and the locking means includes a dimple in the outside surface for maintaining the lever and plate in an open position such that the particles and solution in the cell flow substantially without obstruction whereby the high density particles and low density particles become separated by centrifugation.

5. A gravimetric cell for the centrifugal separation of coal comprising:

a cell for centrifugal separation of high density particles from low density particles, and having a lower portion in which the high density particles reside and form a sink layer when they are separated from the low density particles, an upper portion in which the low density particles reside and form a float layer after separation from the high density particles, a central portion between said lower portion and said upper portion, and an open top;

means for selectively sealing and unsealing said open top;

isolation means at the central portion and positionable in an open position to provide an opening of substantially unrestricted diameter between the upper and lower portions of the cell during centrifugation, and positionable in a closed position to completely separate the sink layer and float layer after centrifugation, and without disturbing either layer; and, locking means engageable with the isolation means for maintaining the isolation means in an open position during centrifugation and wherein the locking means is releasable after centrifugation for positioning the isolation means in a closed position.

* * * * *